US008876487B2

(12) United States Patent
England et al.

(10) Patent No.: US 8,876,487 B2
(45) Date of Patent: Nov. 4, 2014

(54) WATER PUMP SYSTEM AND METHOD

(75) Inventors: Roger D. England, Columbus, IN (US); Mike Abraham, Charleston, SC (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 284 days.

(21) Appl. No.: 13/053,003

(22) Filed: Mar. 21, 2011

(65) Prior Publication Data

US 2011/0286858 A1 Nov. 24, 2011

Related U.S. Application Data

(60) Provisional application No. 61/331,162, filed on May 4, 2010.

(51) Int. Cl.
*F04D 13/02* (2006.01)
*F04D 15/02* (2006.01)
*F04B 35/00* (2006.01)

(52) U.S. Cl.
CPC ..... *F04B 35/002* (2013.01); *F04D 13/021* (2013.01); *F04D 15/0218* (2013.01)
USPC ..... 417/20; 417/15; 417/223; 417/43

(58) Field of Classification Search
CPC ..... F04B 49/02; F04B 17/05; F04B 2207/703
USPC ..... 417/15, 20, 223, 43
See application file for complete search history.

(56) References Cited

U.S. PATENT DOCUMENTS

| | | | | |
|---|---|---|---|---|
| 3,599,869 | A * | 8/1971 | Oberdorfer | 239/172 |
| 3,630,642 | A | 12/1971 | Osterman | |
| 3,684,406 | A | 8/1972 | Edwards | |
| 3,959,971 | A | 6/1976 | Mekari | |
| 4,016,825 | A * | 4/1977 | Pichl | 440/88 R |
| 4,367,699 | A | 1/1983 | Evans | |
| 4,630,036 | A * | 12/1986 | Ford | 340/622 |
| 5,095,855 | A | 3/1992 | Fukuda et al. | |
| 5,100,298 | A | 3/1992 | Shibata et al. | |
| 6,481,390 | B1 | 11/2002 | Robb | |
| 6,513,463 | B2 | 2/2003 | Katayama | |
| 6,672,919 | B1 * | 1/2004 | Beson | 440/89 R |
| 6,802,283 | B2 | 10/2004 | Liederman et al. | |
| 2002/0131866 | A1 * | 9/2002 | Phillips | 417/36 |
| 2006/0027547 | A1 * | 2/2006 | Silvestro | 219/133 |

FOREIGN PATENT DOCUMENTS

JP 04-0005425 1/1992

OTHER PUBLICATIONS

Trickett Marine Products (TMP); Sea Water Cooling Pumps; www.tmp-rawwaterpumps-racorffilters.co.uk/KMP.html; Mar. 2, 2010.

* cited by examiner

*Primary Examiner* — Charles Freay
*Assistant Examiner* — Christoper Bobish
(74) *Attorney, Agent, or Firm* — Faegre Baker Daniels LLP

(57) ABSTRACT

This disclosure relates a water pump control system for an internal combustion engine, and a method for operating an internal combustion engine including a clutch-controlled water pump. The water pump control system and method provide protection of the pump impeller during dry pump operation, such as when a watercraft engine is started while the watercraft is out of water, by turning off the clutch-controlled pump when no water is detected at the inlet of the water pump.

10 Claims, 2 Drawing Sheets

WATER PUMP SYSTEM AND METHOD

FIELD OF THE INVENTION

The invention relates to a system for cooling engine components of an internal combustion engine and to control of cooling system components of an internal combustion engine.

BACKGROUND

Marine engines typically draw water from the operating environment to perform heat exchange with elements of a watercraft. For example, sea water can be drawn in via a seacock in the hull of a watercraft to cool engine components and provide air conditioning of the watercraft quarters. To create a sufficient flow of water for such applications, an engine crankshaft drives a raw water pump of an open loop system mounted on or near the engine to pump water directly through water jackets of the engine or through a heat exchanger including piping of a closed loop cooling system.

SUMMARY

A water pump control system for an internal combustion engine, and a method for operating an internal combustion engine including a clutch-controlled water pump, are provided by the invention.

More particularly, embodiments consistent with the claimed invention relate to a water pump control system for a marine internal combustion engine that includes a water pump having an inlet, an outlet, and a rotatable impeller. The water pump is operable to receive water at the inlet of the water pump and to move that water to the outlet of the water pump. Operation of the water pump is controlled via a clutch having a driven portion mechanically coupled to the internal combustion engine, a driving portion connected with the water pump, and an engaging portion activatable to mechanically couple the driven and driving portions. The system includes a manipulatable switch connected to the clutch, which is settable to an activating mode that causes the engaging portion to mechanically couple the driven and driving portions of the clutch, and to a deactivating mode that causes the engaging portion to mechanically decouple the driven and driving portions of the clutch.

In another aspect consistent with the claimed invention, a water pump control system for a marine internal combustion engine includes a water pump having an inlet, an outlet, and a rotatable impeller. The water pump is operable to receive water at the inlet of the water pump and to move that water to the outlet of the water pump. Operation of the water pump is controlled via a clutch having a driven portion mechanically coupled to the internal combustion engine, a driving portion connected with the water pump, and an engaging portion activatable to mechanically couple the driven and driving portions. The control system includes a water presence sensor that is provided on the inlet side of the water pump to sense the presence of water and provide a water presence signal indicating whether water is available for the operation of the water pump. A switch is connected to the clutch and is set to an activation mode in which power is provided to the engaging portion to mechanically couple the driven and driving portions of the clutch if the water presence signal indicates water is available. If the water presence signal indicates water is not available at the pump inlet, the switch is set to a deactivation mode in which power is not provided to the engaging portion to mechanically decouple the driven and driving portions.

In yet another aspect consistent with the claimed invention, a method of operating a marine internal combustion engine having a clutch-controlled water pump includes sensing for the presence or absence of water at an inlet of the water pump. With the sensed presence indicating presence of water at the inlet of the water pump, power is provided to the clutch to mechanically couple torque from the internal combustion engine to the water pump. With the sensed presence indicating absence of water at the inlet of the water pump, power is prevented from reaching and activating the clutch to mechanically decouple torque from the internal combustion engine from the water pump.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

Figure 1:
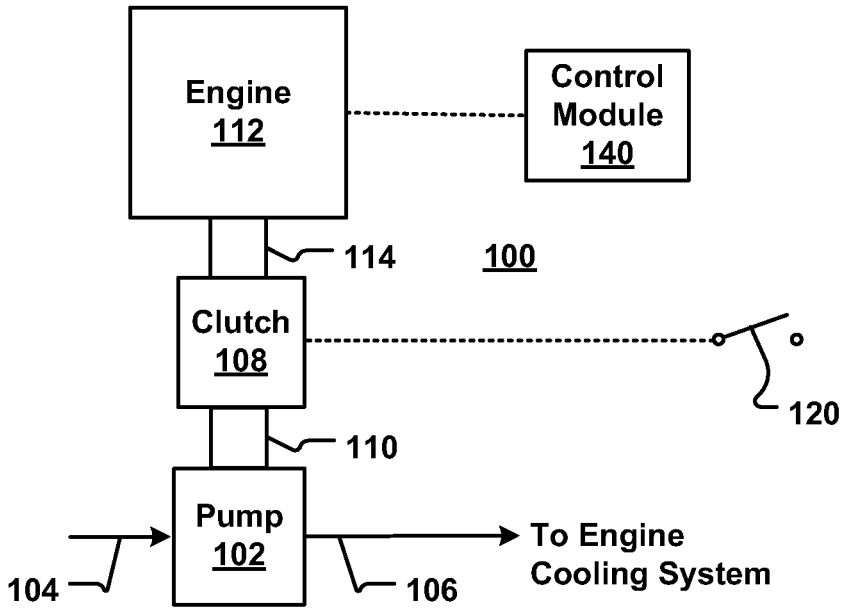
FIG. 1 is a schematic diagram of a system that controls a water pump according to an exemplary embodiment.

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art. Descriptions of well-known functions and constructions are omitted for clarity and conciseness. Further, it should be emphasized that the terms "comprises" and "comprising," when used in this specification, are taken to specify the presence of stated elements, features, integers, steps or components; but the use of these terms does not preclude the presence or addition of one or more other elements, features, integers, steps, components or groups thereof.

Many aspects of the invention are described in terms of sequences of actions to be performed by elements of a computer system or other hardware capable of executing programmed instructions, such as a control module, controller or other device responsive to receiving a signal. It will be recognized that in each of the embodiments, the various actions could be performed by specialized circuits (e.g., discrete logic gates interconnected to perform a specialized function), by program instructions, such as program modules, being executed by one or more processors (e.g., a central processing unit (CPU) or microprocessor), or by a combination of both. Logic of embodiments consistent with the claimed invention can be implemented with any type of appropriate hardware and/or software, with portions residing in the form of computer readable storage medium with a control algorithm recorded thereon such as the executable logic and instructions disclosed herein, and can be programmed, for example, to include one or more look-up tables and/or calibration parameters. The computer readable medium can comprise a random access memory (RAM), a read-only memory (ROM), an erasable programmable read-only memory (EPROM or Flash memory), an optical fiber, and a portable compact disc read-only memory (CD-ROM), or any other solid-state, magnetic, and/or optical disk or other tangible medium capable of storing information. Thus, various aspects can be embodied in many different forms, and all such forms are contemplated to be consistent with the scope of the claimed invention.

There are a number of situations in which it is desirable to run an engine of a marine vessel (watercraft) while the watercraft is out of water. For example, maintenance of a watercraft can require running the watercraft engine while the watercraft is trailered, lifted from water, on the deck or davit of a larger vessel, or placed in dry dock. Other situations in which it can be desirable to start a watercraft engine and quickly brought into operational mode before placing the watercraft in water include military applications that tender a boat on a ship prior to dropping it in the water, particularly in battle situations, or search and rescue deployments. For instance, starting a watercraft engine while the watercraft is attached to a ship's davit allows the engine can reach operational temperature before it is lowered into the water, which more efficiently utilizes time between an order and deployment, and thus facilitates more rapid deployment of the watercraft.

At the same time, the inventors recognized that starting an engine of a watercraft while the watercraft is out of water, or when water is not otherwise present at the inlet of the pump, would cause an impeller of the marine engine's water pump to spin in a dry state and eventually fail because water would not be available to lubricate and cool the impeller. While an impeller can safely withstand a limited amount of dry spinning, an extended amount of dry running time would cause an extended duration of friction forces acting on the impeller that can heat the impeller until it eventually fails. For example, it can take more than twenty minutes at idle for coolant in a closed loop cooling system of a diesel engine to attain operating temperature. A sea water impeller running for this amount of time can be destroyed after about five minutes, and at rated engine speed, an impeller can fail after about ninety seconds. The water pump control system and method of operating a marine internal combustion engine described herein extends the time that a watercraft engine can operate when water is not available at the water pump inlet without damaging the impeller of the pump.

FIG. 1 shows an exemplary system 100 that can be used to control whether a water pump 102 is driven by a marine internal combustion engine 112 of a watercraft (not shown). As shown in FIG. 1, the water pump 102 can be controlled to be coupled or decoupled from the engine 112 by way of a clutch 108. The clutch 108 includes a driving portion 110, such as a shaft that is mechanically coupled to, or integral with an impeller shaft (not shown) of the water pump 102. The impeller shaft rotates an impeller (not shown) within a chamber of the pump 102 to move water entering the chamber through an inlet 104 of the water pump 102 to an outlet 106 of the water pump 102. Water from the outlet 106 can be provided to a cooling circuit (not shown) of the marine internal combustion engine 112, which can include either an open loop cooling system or closed loop cooling system.

The clutch 108 includes a driven portion 114, such as a shaft, which can be mechanically, electro-mechanically, or electromagnetically coupled to the pump driving portion 110 by engaging opposing frictional plate surfaces (not shown) connected to the ends of the driven portion 114 and driving portion 110. For example, exemplary embodiments can utilize an electromagnetic clutch 108 having one end thereof mounted on an input shaft of the water pump 102, and the other end is mounted a pulley that is mechanically coupled to the crankshaft of engine 112. Such a clutch includes a coil, which when energized, couples the pulley to the input shaft of the pump 102 and transfers torque at the pulley to the pump input shaft. Other exemplary embodiments can include a clutch that is different from the electromagnetic type. For instance, a solenoid can be provided with an electromechanical type clutch 108 at the water pump 102 to move a member that mechanically engages and disengages a driven portion 114 and a driving portion 110 of such a clutch.

In some exemplary embodiments, the marine internal combustion engine 112 can be controlled by a control module 140, for example, an electronic engine control module (ECM) or an engine control unit (ECU), that senses several engine and environmental parameters (e.g., engine temperature, speed, air intake pressure, throttle position etc.) and determines various performance parameters (e.g., ignition, valve or injection timing, air/fuel mixture, idle speed etc.) for operating the engine 104. In other embodiments, the engine 112 can be controlled by more than one control module 140, or no electronic module, such as an engine controlled via a combination of mechanical and pneumatic components.

To control operation of the pump 102, system 100 includes a manually operable on/off switch 120 that controls whether the driven portion 114 engages the driving portion 110, and therefore whether the water pump 102 is driven by the crankshaft of the engine 104. The on/off switch 120 can include a default position that causes the clutch 108 to engage the driven portion 114 and driving portion 110 so the engine 112 can drive the water pump 102. For example, the on/off switch 120 can be in a default "on" position, or activation mode when the watercraft is powered on, which connects a power source to the clutch 108 to engage the driven portion 114 with the driving portion 110. When it is desired to operate the engine 112 while the watercraft is out of the water, the on/off switch 120 can be manipulated by the switch operator to set it at its "off" position places the switch 120 in a deactivation mode that causes the pump 102 to disengage from the engine 112 and allow the engine 112 to run without turning the pump's impeller for a period of time determined by the operator of the switch 120.

To warn the watercraft operator to set the switch 120 in its "on" (clutch engaging) position, the watercraft can include an audible and/or visual alarm signal generator that generates an alarm signal. In some exemplary embodiments, the alarm signal such as a warning light (not shown) and/or a sound can be generated the entire time the engine 112 is running while the pump is in the deactivated mode. In some exemplary embodiments, the control module 140 can sense the temperature of one or more engine components, or coolant fluid in closed engine cooling system, and activate a warning light and/or sound when the sensed temperature exceeds a predetermined threshold value. A timer also can be utilized to similarly warn the watercraft operator if the on/off switch 120 has been placed in the "off" position with the engine 112 running for a predetermined period of time. In some exemplary embodiments, after a predetermined time period, or after a time period set by an operator using a timer associated with the switch, the on/off switch 120 can automatically return to a default position in which the clutch 108 engages the driven portion 114 and driving portion 110 so the water pump 102 operates.

The on/off switch 120 can be installed anywhere on a watercraft. For example, the on/off switch 120 can be installed near the ignition switch at the helm, at the rear of the watercraft, near the engine, or at any other accessible position on the watercraft. The exemplary embodiment shown in FIG. 1 can readily be retrofitted to an existing watercraft or factory installed with a new watercraft.

Figure 2:
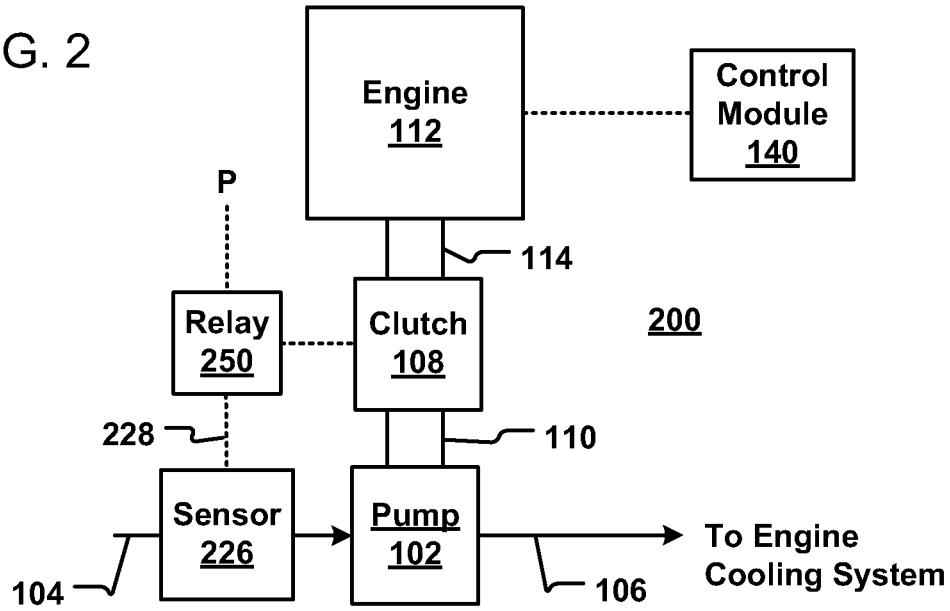
FIG. 2 is a schematic diagram of a system that automatically controls a water pump according to an exemplary embodiment.

FIG. 2 shows an exemplary embodiment of a system 200 that can be used to automatically control whether a water pump 102 is driven by a marine internal combustion engine 112. Items depicted having the same reference numbers as items in system 100 are described above. During normal operation in a marine environment, raw water, for example, salt water from a sea, ocean or bay or fresh water from a river, lake or pond, can enter through a seacock in the hull of the watercraft and thereafter enter the inlet 104 of the water pump 102. The system 200 includes water presence sensor 226 that is positioned on the inlet side of the water pump 102 to sense the presence or absence of the raw water at the pump inlet 104. The sensor 226 can be positioned at the inlet 104 of the pump 102, anywhere along the fluid path from the seacock to the inlet 104, or elsewhere where water would be present with the watercraft in water (e.g., along the hull where water is expected to be present).

As shown in FIG. 2, the water presence sensor 226 is electrically connected to a communication line 228, and can provide a voltage or current signal on the communication line 228 when it senses that water is present at the pump inlet 104. A relay 250, or other switching device such as on/off solenoid, is electrically connected to the communication line 228 and to a power source P. With a signal received from the water presence sensor 226 indicating presence of water, the relay 250 switches to an activation mode in which power P from a power source is supplied to the clutch 108 to engage the driven portion 114 with the driving portion 110, which causes the pump impeller to rotate and turn on the water pump 102. With the output from the water presence sensor 226 indicating absence of water at the inlet 104 of the pump 102, the relay 250 enters a deactivation mode in which power P is not supplied to the clutch 108. In the deactivation mode, the clutch disengages the driven portion 114 from the driving portion 110, and the water pump 102 is turned off.

As can be seen, the system 200 can automatically couple or decouple torque from the engine 112 to the impeller shaft of the water pump 102 based on the signal value provided from the water presence sensor 226. As described above, an alarm signal can be generated in some exemplary embodiments to warn an operator that the engine 112 is running while the pump 102 is deactivated (turned off), when components of the engine 112 exceed a predetermined temperature while the pump 102 is turned off, and/or if the pump 102 has been turned off for a predetermined period of time while running the engine 112. Exemplary embodiments consistent with the system shown in FIG. 2 can be retrofitted to an existing watercraft or factory installed with new watercraft.

Figure 3A:
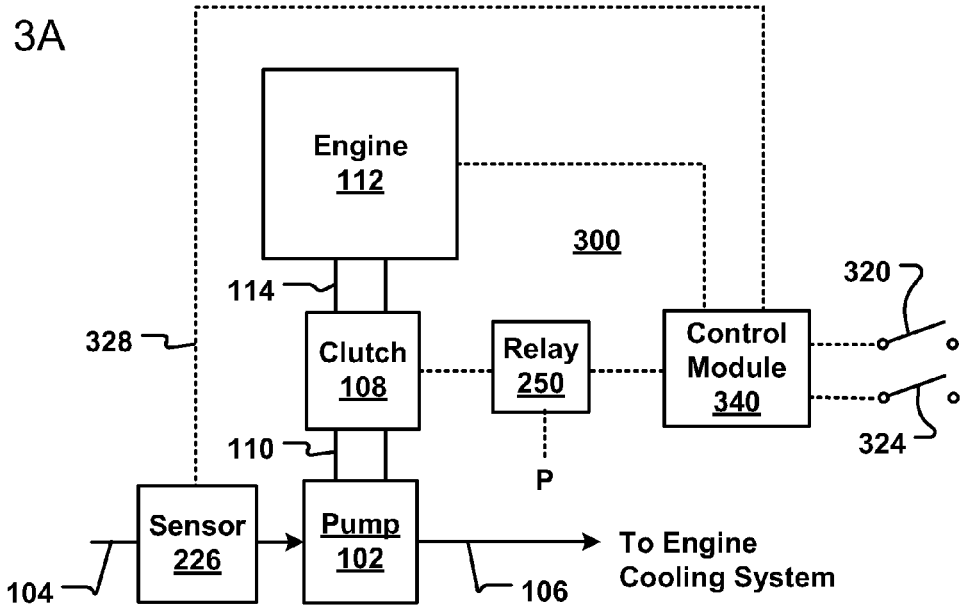
FIG. 3A is a schematic diagram of a system that automatically controls a water pump using a control module according to an exemplary embodiment.
Figure 3B:
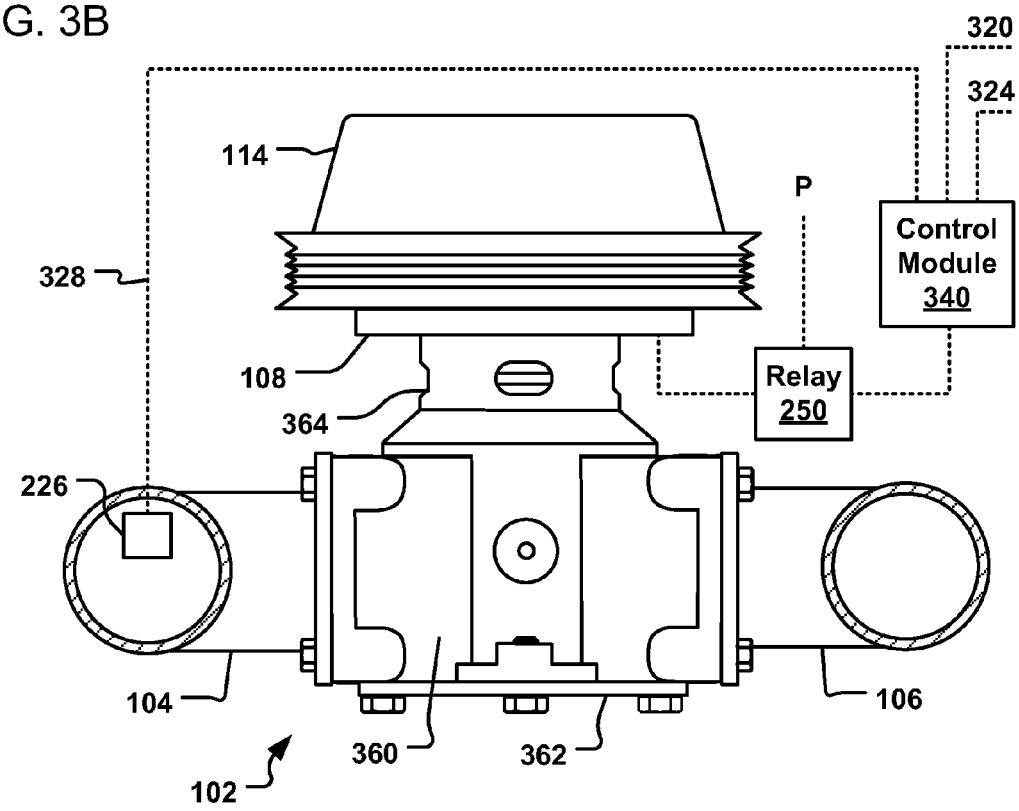
FIG. 3B is a diagram of an exemplary system of the type shown in FIG. 3A and includes a top view diagram of a water pump.

FIG. 3A shows an exemplary embodiment of a system 300 that controls whether a water pump 102 is driven by a marine internal combustion engine 112. FIG. 3B is a more detailed diagram of an exemplary embodiment of the system 300 showing a top view of an exemplary water pump 102. Items depicted in FIGS. 3A and 3B and having the same reference numbers as items in systems 100 and 200 are described above.

The system 300 includes a control module 340, such as an ECM or ECU, or one or more or other electronic controller separate from an ECM or ECU of the marine engine 112. In embodiments using a separate control module, such separate control module can be in electrical communication with the ECM or ECU of the engine 112, and thus receive inputs from the engine's module. The control module 340 can provide a control signal to the relay 250 to control whether the driven portion 114 engages with the driving portion 110 to transfer torque from the engine 112 to the shaft of the pump 102, and thus turn on the pump 102. While the clutch 108 in this embodiment is an electromagnetic type clutch, other clutch types can be used, such as those mentioned above.

With reference to FIG. 3B, the water pump 102 includes a chamber 360 containing the pump impeller (not shown) and an access cover plate 362 sealingly enclosing the chamber 360. The driven portion 110 of FIG. 3A includes the impeller shaft (not shown), which in FIG. 3B is provided in a vertical orientation within the chamber 360 and a housing portion 364 of the water pump 102. The impeller shaft is connected to a friction plate at one end of the clutch 108. On the other end of the clutch 108, the driving portion 114 includes a pulley that is coupled to the engine 112 via a belt (not shown), and is attached to at least one friction surface that engages/disengages with the friction surface of the impeller shaft to couple/decouple torque from the engine 112. It is to be understood, however, that the internal combustion engine 112 can be mechanically coupled to the driven portion 114 of the clutch 108 using mechanical means other than a pulley and belt system.

The control module 340 can receive a start signal from an ignition/start switch 324 and a water presence signal from communication line 328 and generated by water sensor 226 positioned on the inlet 104 side of the water pump 102. At the time of starting the engine 112, the control module 340 can determine whether to engage the engine 112 and water pump 102 based on the state of the signal received from the water presence sensor 226. If the water presence signal on line 328 indicates presence of water, the control module supplies a signal to relay 250 that causes the relay 250 to supply power P, for example 12 or 24 volts, to the clutch 108. For example, the power P can be supplied to a coil (not shown) of the depicted electromagnetic clutch 108, which causes frictional surfaces of the clutch to engage the driven portion 114 and the driving portion 110. The control module 340 can optionally receive a signal from a manipulatable control switch 320 to directly control the whether the clutch 108 engages to transfer torque from the crankshaft of the engine 112 to the impeller shaft of the water pump 102, although some embodiments can omit the manipulatable control switch 320. If used, the manipulatable control switch 320 can be positioned on the watercraft as described above with respect to switch 120.

The control module 340 allows for flexibility in controlling operation of the clutch 108. For example, in some embodiments the control module 340 can determine whether to modulate on/off times of the clutch 108 to provide an amount of water to the outlet of the pump based on monitored operating parameters, such as engine speed and engine temperature. Alternatively, in some embodiments, the clutch 108 can be a variable speed clutch that provides multiple degrees of coupling between the driven portion 114 and the driving portion 110 intermediate of the on and off states. In such an embodiment, the water pump 102 can be controlled to acquire torque from the engine crankshaft in a range of values from an off state to a fully on state to provide water at a rate corresponding amount required by the engine 112. In some embodiments, the control module can include a look up table or perform a calculation to determine an appropriate setting for the pump torque.

The water pump 102 can be attached to, mounted with, or otherwise driven by the crankshaft of the engine 112 to pump water from the environment in which the watercraft operates. During normal operation in a marine environment, raw water, for example, salt water from a sea, ocean or bay, or fresh water from a river, lake or pond, can enter through a seacock in the hull of the watercraft and thereafter enter the inlet 104 of the pump. The systems described herein for controlling the pump 102 facilitate starting marine vessel engines, such as tender boats, prior to dropping them in water. This can allow the marine vessel engine to reach operating temperature around the same time the boat is placed in water, and thus decrease time of deployment in time-sensitive military and rescue applications.

Although a limited number of embodiments is described herein, one of ordinary skill in the art will readily recognize that there could be variations to any of these embodiments and those variations would be within the scope of the appended claims. For example, some embodiments can provide protection of water pump components while a watercraft is in water, but water flow to the pump inlet is obstructed. In such an application, a user can be alerted that an obstruction has occurred, and engine operation can safely continue for a limited amount of time.

Thus, it will be apparent to those skilled in the art that various changes and modifications can be made to the water pump system and method described herein without departing from the scope of the appended claims and their equivalents.

What is claimed is:

1. A water pump control system for a marine internal combustion engine, comprising:

a water pump in a watercraft, the pump having an inlet, an outlet, and a rotatable impeller, said water pump operable to receive water at the inlet of the water pump and to move that water to the outlet of the water pump, said outlet fluidly coupled to a cooling circuit of the internal combustion engine;

a clutch having a driven portion mechanically coupled to the internal combustion engine, a driving portion connected with the water pump, and an engaging portion activatable to mechanically couple the driven and driving portions;

a sensor operable to sense the presence of water and generate a water presence signal indicating the presence or absence of water which is indicative of whether the watercraft is in or out of the water; and a switch connected to the clutch, said switch operable to be set to an activation mode in which power is provided to the engaging portion to mechanically couple the driven and driving portions if said sensor senses the presence of water indicative of the watercraft is being positioned in water, and said switch operable to be set to a deactivation mode in which power is not provided to the engaging portion to mechanically decouple the driven and driving portions if said sensor does not sense the presence of water indicative of the watercraft being positioned out of water.

2. The water pump control system of claim 1, further comprising a control module in a communication path between the sensor and the switch; wherein, if said sensor senses the presence of water indicative of the watercraft being positioned in water, said control module is operable to provide an activation signal to the switch causing the switch to operate in the activation mode; and if said sensor senses the absence of water indicative of the watercraft being positioned out of water, said control module is operable to provide a deactivation signal to the switch that causes the switch to operate in the deactivation mode.

3. The water pump control system of claim 2, wherein the control module is an engine control module (ECM) or engine control unit (ECU).

4. The water pump control system of claim 1, wherein said clutch is an electromagnetic clutch.

5. The water pump control system of claim 1, wherein the water pump and the clutch are integrated into a single component.

6. The water pump control system of claim 1, further comprising an alarm signal generator that activates an alarm signal when the engine is running and said switch is in the deactivating mode.

7. A method of operating a marine internal combustion engine in a watercraft, said internal combustion engine including a clutch-controlled water pump fluidly coupled to a cooling circuit of the internal combustion engine, comprising:

sensing for the presence or absence of water indicative of whether the watercraft is in or out of water;

with presence of water sensed indicative of the watercraft being in the water, providing power to the clutch to mechanically couple torque from the internal combustion engine to the water pump; and with the absence of water sensed indicative of the watercraft being out of water, preventing power to the clutch to mechanically decouple torque from the internal combustion engine to the water pump.

8. The method of operating an internal combustion engine of claim 7, wherein, the method further comprises:

generating an alarm signal with the internal combustion engine running and the power is not supplied to said clutch.

9. The method of operating an internal combustion engine of claim 8, wherein generating an alarm signal with the internal combustion engine running and said power is not supplied to the clutch only occurs after one of:

elapse of a predetermined time period; and at least one engine component has reached a temperature exceeding a predetermined threshold value.

10. The method of claim 7, wherein the clutch is a variable speed clutch, and the method further comprises:

sensing at least one parameter of operation of the speed of the internal combustion engine; and controlling the clutch speed based on the sensed parameter value.

* * * * *